US008117973B1

(12) United States Patent
Frank

(10) Patent No.: US 8,117,973 B1
(45) Date of Patent: Feb. 21, 2012

(54) TELESCOPIC SECURITY BOX SYSTEM

(76) Inventor: Donald E. Frank, St. Petersburg, FL (US)

( * ) Notice: Subject to any disclaimer, the term of this patent is extended or adjusted under 35 U.S.C. 154(b) by 0 days.

(21) Appl. No.: 13/066,479

(22) Filed: Apr. 15, 2011

Related U.S. Application Data

(60) Provisional application No. 61/342,565, filed on Apr. 16, 2010, provisional application No. 61/404,459, filed on Oct. 4, 2010.

(51) Int. Cl.
*E05G 1/04* (2006.01)

(52) U.S. Cl. ..... 109/51; 70/63; 109/50; 109/52; 109/47; 109/49; 312/205; 220/8

(58) Field of Classification Search ..... 70/63; 109/50, 109/51, 52, 47, 49; 312/205, 242, 409, 245, 312/265.5; 220/8, 528, 529, 625, 627
See application file for complete search history.

(56) References Cited

U.S. PATENT DOCUMENTS 1,941,375 A * 12/1933 Wildman ..... 220/8
3,899,983 A * 8/1975 Hernandez ..... 109/54
4,123,978 A * 11/1978 Lentini ..... 109/51
5,139,186 A * 8/1992 Loew et al. ..... 220/8
5,412,960 A * 5/1995 James et al. ..... 70/63
5,595,431 A * 1/1997 Mlakar ..... 312/409
5,738,020 A * 4/1998 Correia ..... 109/51
6,709,078 B2 * 3/2004 Johnson ..... 312/205
7,350,470 B1 * 4/2008 Stuhlbarg et al. ..... 109/73
7,654,388 B2 * 2/2010 Catron ..... 206/538
2008/0149008 A1 * 6/2008 Hall ..... 109/51

OTHER PUBLICATIONS

Really Right Stuff, Dec. 1, 2006, http://web.archive.org/web/20061201050425/http://reallyrightstuff.com/clamps/index.html, pp. 1-17.*

* cited by examiner

*Primary Examiner* — Lloyd Gall
*Assistant Examiner* — David E Sosnowski

(57) ABSTRACT

A front component has top and bottom panels separated by a height. Left and right side panels are separated by a width. A rear opening and parallel front openings are separated by a depth. A rear component has top and bottom panels separated by a height. Left and right side panels are separated by a width. A rear panel and a parallel front opening are separated by a depth. The rear component is slidable between a forward contracted orientation and a rearward extended orientation. A door with a hinge pivotally couples the door to the front opening of the front component. A lock is adapted to selectively lock the door in the closed orientation. A size limiter precludes the rear component from moving rearwardly and separating from the front component.

9 Claims, 14 Drawing Sheets

FIG 1
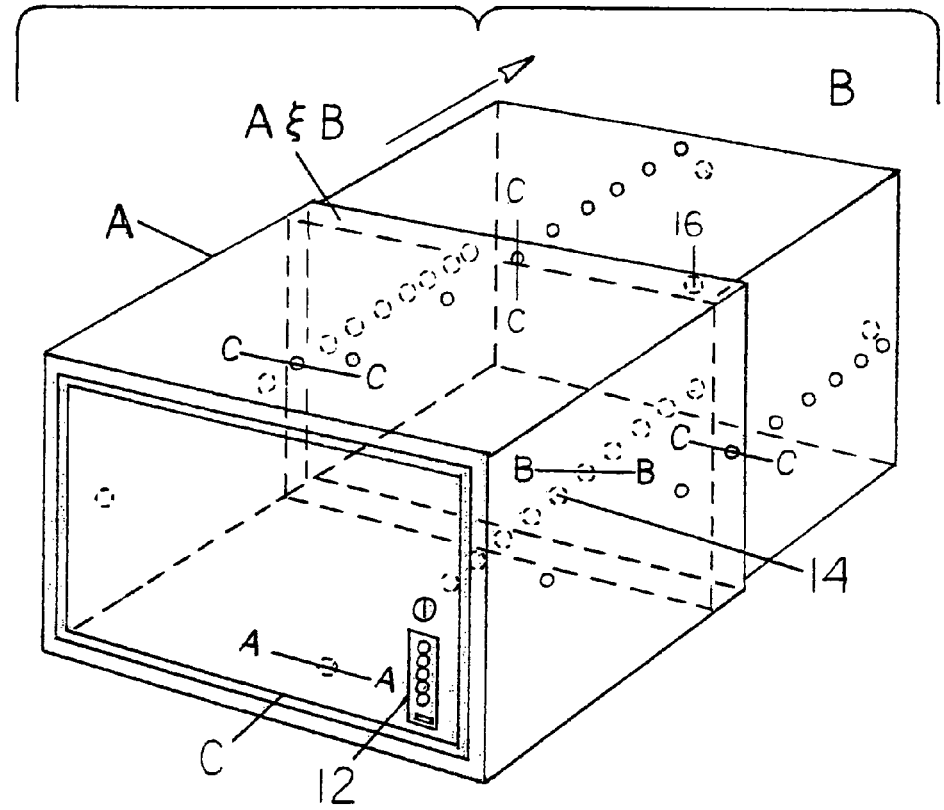
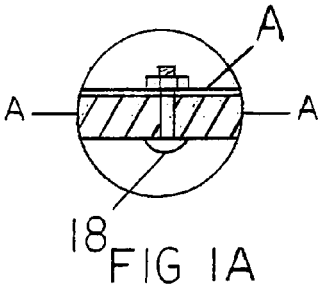
FIG 1A
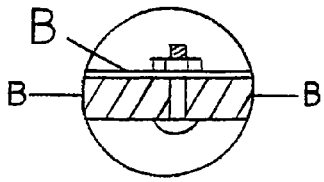
FIG 1B
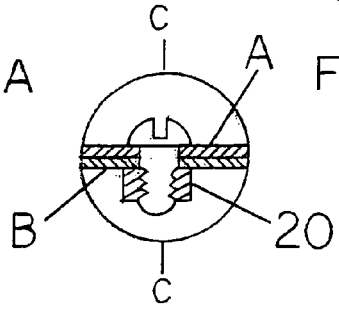
FIG 1C
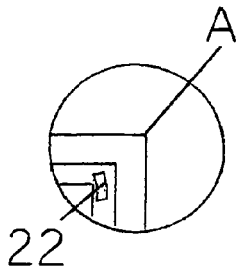
FIG 1D

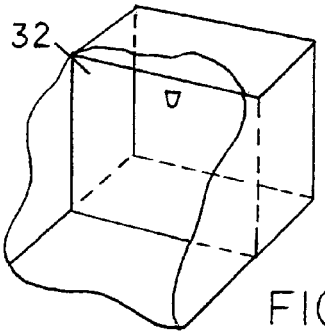
B
FIG 8
FIG 9
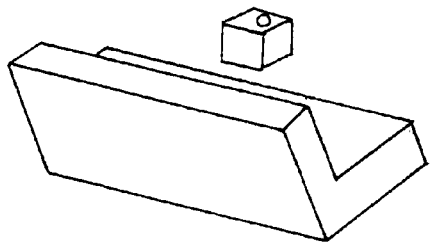
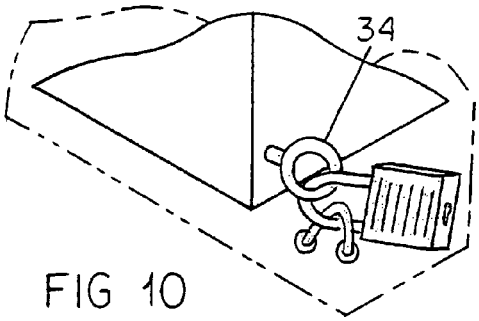
FIG 10
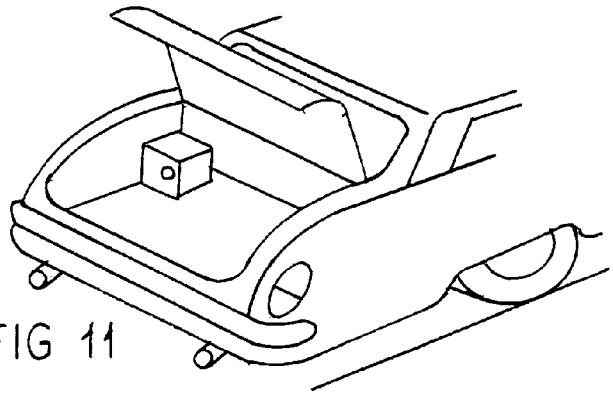
FIG 11
FIG 12
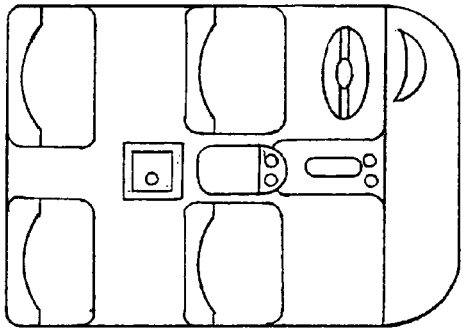

TELESCOPIC SECURITY BOX SYSTEM

RELATED APPLICATION

The present patent application is based upon pending Provisional Application Nos. 61/342,565 filed Apr. 16, 2010, and 61/404,459 filed Oct. 4, 2010, the subject manner of which application is incorporated herein by reference.

BACKGROUND OF THE INVENTION

Field of the Invention

The present invention relates to a telescopic security box system and more particularly pertains to storing valuables in homes, vehicles, work places and the like, the system having size varying capabilities to facilitate storage and transportation and to allow positioning at a wide variety of locations, the storing and transporting and positioning being done in a safe, convenient and economic manner.

SUMMARY OF THE INVENTION

Affordable home type security boxes are often made of 20 gauge sheet steel formed into a hinged security box with built-in key lock. Thus a user can store items reasonably secure from children, burglars or unauthorized persons. Further security is provided by supplied bolts or screws for securing to a closet shelf, wall or other fixed object.

These boxes are limited to one size in depth, for example 13 inches. Therefore not as easily concealed or adaptable to many smaller areas such as upper level kitchen cabinets or secured vertically in a desk file drawer. A non adjustable steel shelf may be provided. This limits the user's ability to store different size items. A shopper could consider it too large or bulky for his/her needs. This home type Telescopic Security Box application will solve all of the above deficiencies and more. A virtually pick proof lock will provide much needed security. No home security box formerly developed provides telescopic size adjustments beneficial to a manufacturer, shipper, warehouse facility, retailer or user.

In view of the disadvantages inherent in the known types of security boxes now present in the prior art, the present invention provides an improved telescopic security box system. As such, the general purpose of the present invention, which will be described subsequently in greater detail, is to provide a new and improved telescopic security box system and method which has all the advantages of the prior art and none of the disadvantages.

The present invention is a telescopically adjusted security box for home, vehicle or workplace and easily manufactured by existing companies, economical and in a compact mode more easily concealed. In addition to installing the box on a closet shelf in the expanded mode the compacted box can be easily secured to a wide variety of surfaces such as: in the upper level of kitchen cabinets, vertically in a desk file drawer, under a desk, or bolted to a steel bed frame. It could be installed in vehicles, either permanently or temporarily, in areas such as: the trunk, eye bolt padlocked to a cargo ring in an SUV, or secured on the center floor of a car, in a truck, SUV or van while taking little space. (Example, a woman could easily secure a small purse while shopping.) It could also be installed in a boat, travel trailer, or motor home. A virtually pick resistant lock should be supplied.

Holes in the bottom, top, sides and back make it possible to have the box installed with the door vertical or horizontal for convenient opening and storage. The interior of cars, trunks, consoles and glove boxes are easily broken into. No mass produced passenger vehicle, that I am aware of, provides an effectively secure storage facility.

A great global need exists for a telescopic, economical, compact security box easily installed in a residence, vehicle or workplace. Prototype is 7¼ high×9¼ wide×7 deep telescoping in many increments to 13 inches. Manufacturing, shipping, warehouse and retail shelf space reduced by 46% compared to a 13 inch box presently marketed. Plus, 30% lighter via a light weight adjustable shelf in lieu of a heavy, fixed steel shelf and supports. 46% smaller+30% lighter=a "green energy saving product." One truck load verses two truck loads saves fuel cost with less environmental pollution, and results in significant savings for the manufacturer, shipper and retailer. Virtually two 7 inch boxes fit in the space of one 13 inch box on a store shelf.

To attain this, the present invention essentially comprises a telescopic security box system. First provided is a front component. The front component is in a generally rectilinear configuration. The front component has a horizontal top panel. The front component has a parallel bottom panel. The top and bottom panels are separated by a height. The front component has a vertical left side panel. The front component has a parallel right side panel. The left and right side panels are separated by a width. The front component has a vertical rear opening. The front component also has a parallel front opening. The rear and front openings are separated by a depth.

A rear component is provided. The rear component is in a generally rectilinear configuration. The rear component has a horizontal top panel. The rear component has a parallel bottom panel. The top and bottom panels are separated by a height. The rear component has a vertical left side panel. The rear component has a parallel right side panel. The left and right side panels are separated by a width. The rear component has a vertical rear panel. The rear component has a parallel front opening. The rear panel and front opening are separated by a depth. The height and width of the rear component are less than the height and width of the front component. The depth of the rear component is essentially equal to the depth of the front component. The rear component is slidable between a contracted orientation and an extended orientation. In the contracted orientation the majority of the rear component is within the front component. In the extended orientation all of the rear component is rearwardly of the front component.

A door is provided. The door has a hinge. The hinge pivotally couples the door to the front opening of the front component adjacent to a side panel of the front component. The door is pivotable between an open orientation and a closed orientation. The open orientation is parallel with the right side panel of the front component. The closed orientation is parallel with and closes the front opening of the front component. The door has a lock. The lock is adapted to selectively lock the door in the closed orientation.

A size limiter is provided. The size limiter includes an in-turned lip at the rear opening of the front component. The size limiter is in sliding contact with the upper and lower and side panels of the rear component. The size limiter includes an out-turned lip at the front opening of the rear component. The out-turned lip is provided in sliding contact with the upper and lower and side panels of the front component. The in-turned lip and the out-turned lip are in interference relationship. In this manner the slide limiter is adapted to preclude the rear component moving rearwardly and separating from the front component. The turned lips of the front and rear components couple together to create an interface of four layers of metal for anti-prying characteristics and maximum security.

In an alternate embodiment of the invention, a plurality of bolt holes are provided. The bolts holes are provided through the upper and lower and side panels of the front and rear components. The bolt holes are aligned midway on all corresponding panels. A bolt is provided. The bolt extends through a bolt hole of the front component and the rear component. In this manner the front and rear components are secured in a fixed orientation with respect to each other.

The panels have a plurality of supplemental holes. The supplemental holes are adapted to facilitate coupling of the system to another object.

The rear component has a false panel. The false panel is provided spaced from and parallel with the rear panel. The false panel is spaced from the rear panel by a distance between 10 and 50 percent of the depth of the rear component, Further provided is a shelf. The shelf is in an inverted U-shaped configuration. The shelf has a horizontal central portion. The shelf has two depending legs. The central portion has a depth less than the depth of the rear component. The legs have an adjustable height of between 40 and 60 percent of the height of the rear component.

Provided last is a prescription drug box. The prescription drug box is in a rectilinear configuration and of a size for being conveniently attached interiorly to the door when opened, provision being made for hanging keys.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved telescopic security box system which has all of the advantages of the prior art and none of the disadvantages.

It is another object of the present invention to provide a new and improved telescopic security box system which may be easily and efficiently manufactured and marketed.

It is further object of the present invention to provide a new and improved telescopic security box system which is of durable and reliable constructions.

An even further object of the present invention is to provide a new and improved telescopic security box system which is susceptible of a low cost of manufacture with regard to both materials and labor, and which accordingly is then susceptible of low prices of sale to the consuming public, thereby making such telescopic security box system economically available to the buying public.

Even still another object of the present invention is to provide a telescopic security box system for storing valuables in homes, vehicles, work places and the like, the system having size varying capabilities to facilitate storage and transportation and to allow positioning at a wide variety of locations, the storing and transporting and positioning being done in a safe, convenient and economic manner.

Lastly, it is an object of the present invention to provide a new and improved telescopic security box system. A front component has top and bottom panels separated by a height. Left and right side panels are separated by a width. A rear opening and parallel front openings are separated by a depth. A rear component has top and bottom panels separated by a height. Left and right side panels are separated by a width. A rear panel and a parallel front opening are separated by a depth. The rear component is slidable between a forward contracted orientation and a rearward extended orientation. A door with a hinge pivotally couples the door to the front opening of the front component. A lock is adapted to selectively lock the door in the closed orientation. A size limiter precludes the rear component from moving rearwardly and separating from the front component.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred and alternate embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

BRIEF DESCRIPTION OF THE DRAWINGS

The invention will be better understood and objects other than set forth above will become apparent when consideration is given to the following detailed descriptions thereof. Such description makes reference to the annexed drawings wherein:

FIG. 1 is a perspective illustration of a telescopic security box constructed in accordance with the principles of the invention. Compartment B is shown fully extended from compartment A.

FIGS. 1 A, 1 B, 1 C, and 1 D illustrate details of construction.

Figure 2:
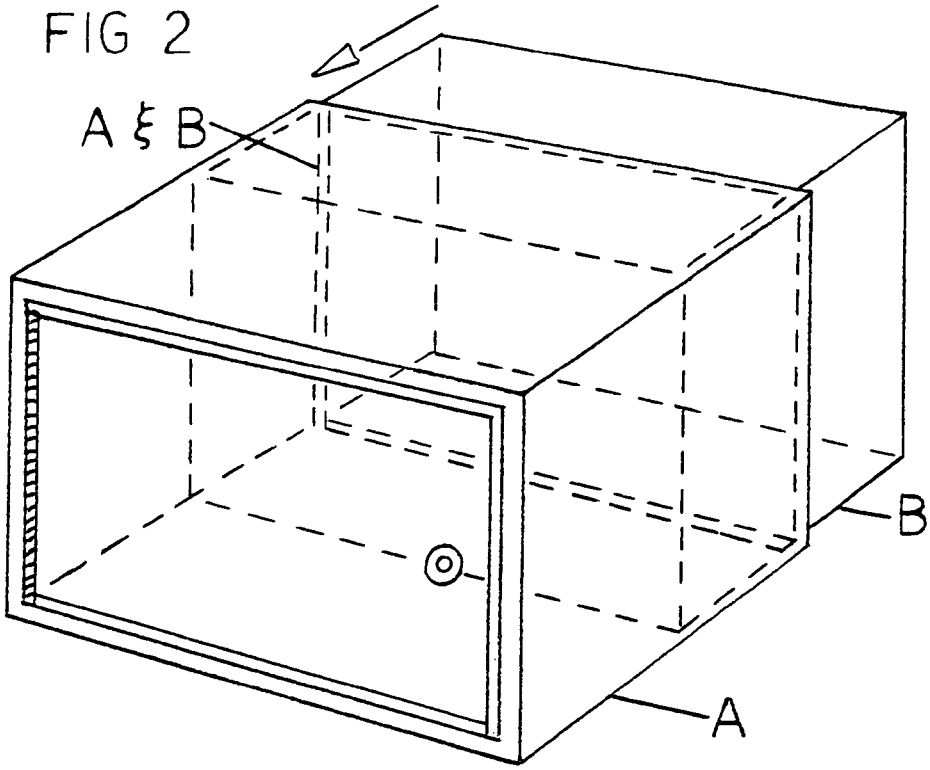

FIG. 2 is a perspective view of the box with compartment B partially extended.

Figure 3:
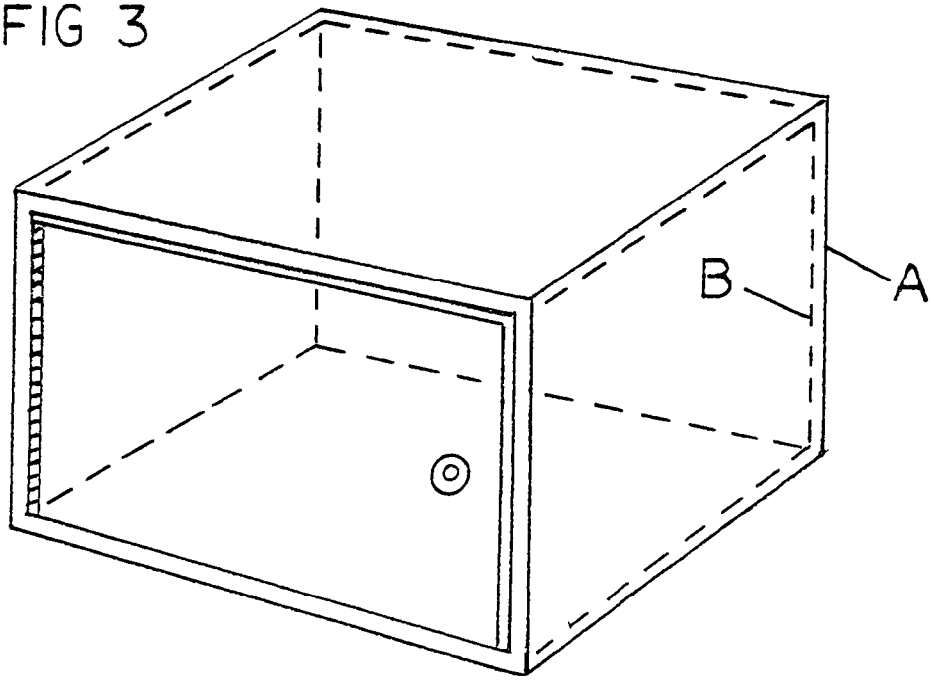

FIG. 3 is a perspective view of the box with compartment B fully compacted within compartment A.

Figure 4:
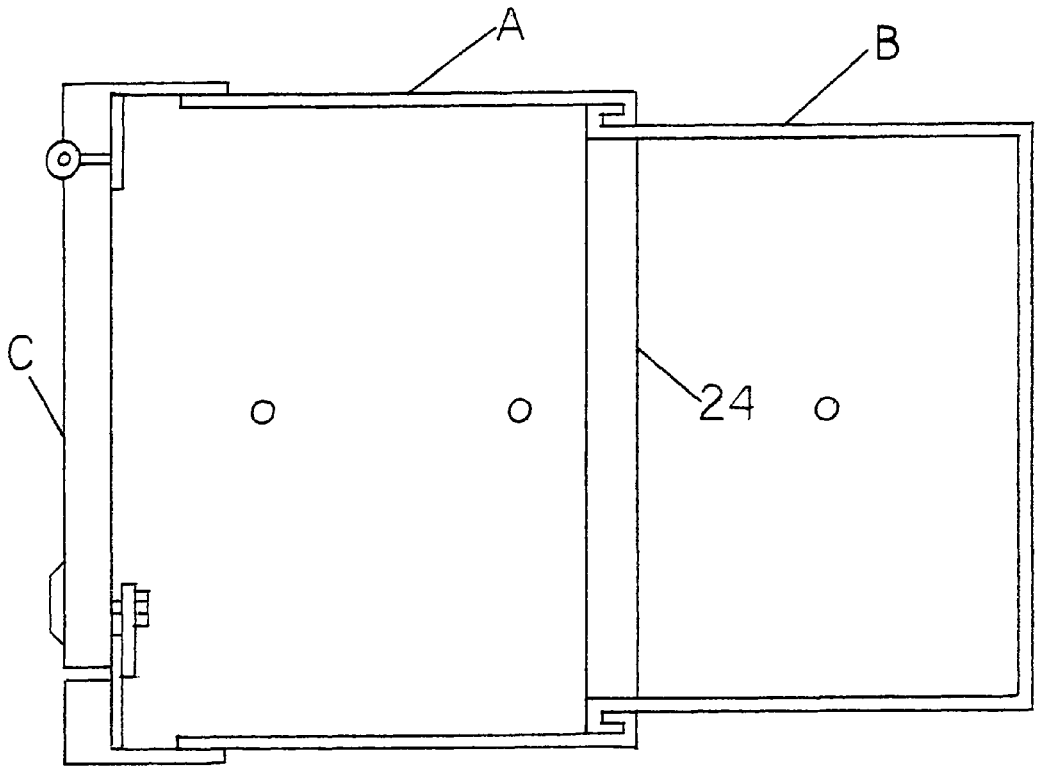

FIG. 4 is a plan view of an alternate method of manufacture wherein compartment A interlocks with compartment B in a 360 degree configuration.

Figure 5:
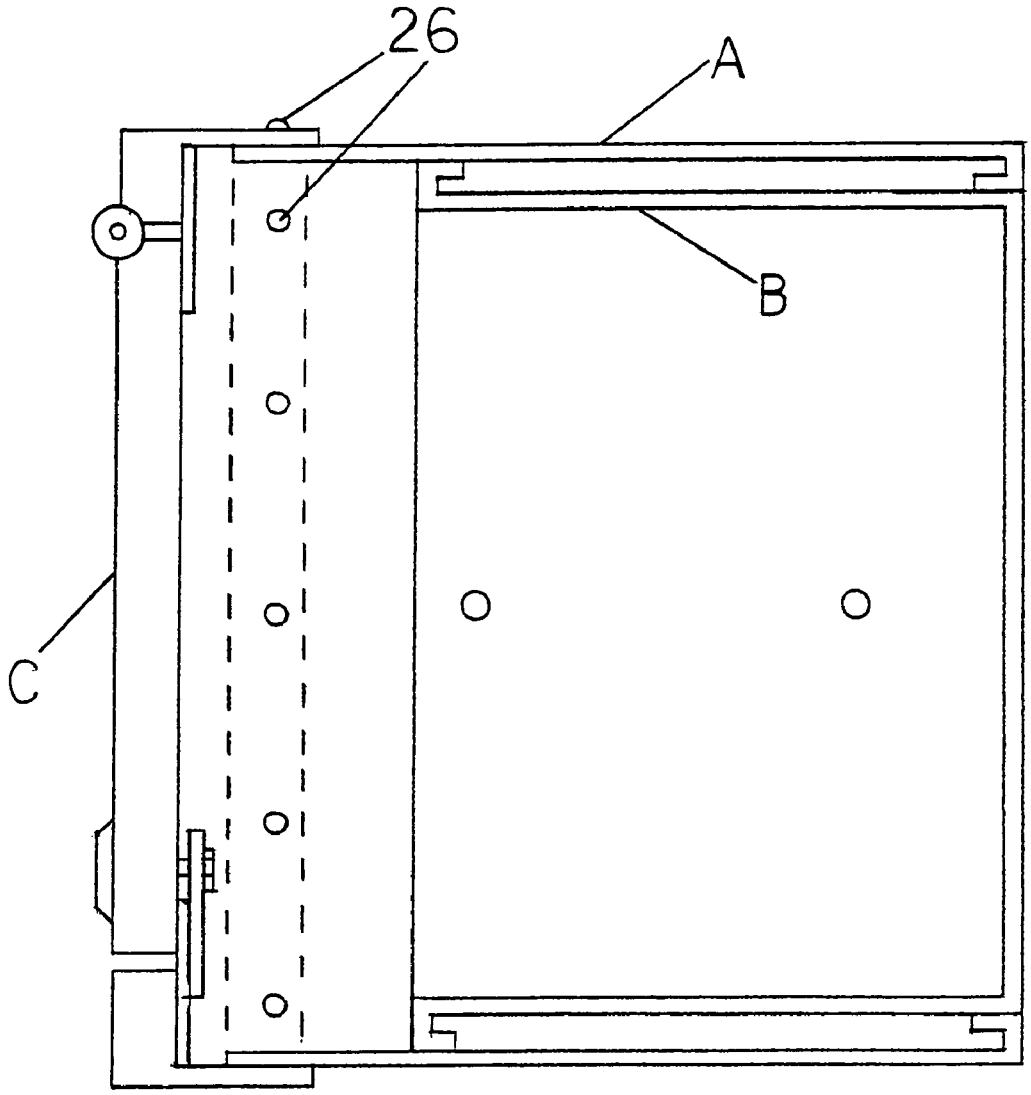

FIG. 5 is a plan view illustrating compartments A and B compacted.

Figure 6:
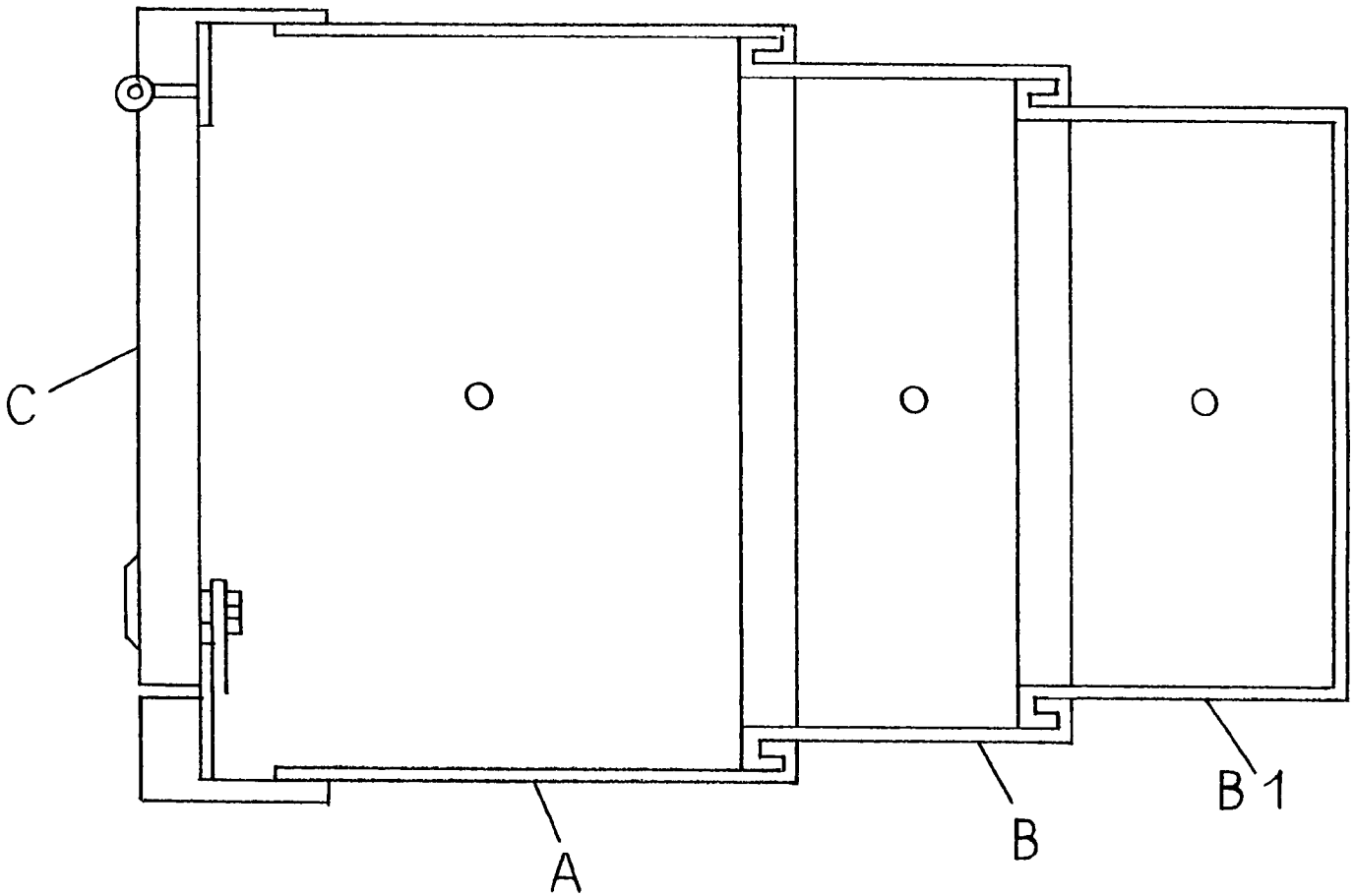

FIG. 6 is a plan view illustrating multiple extensions.

Figure 7:
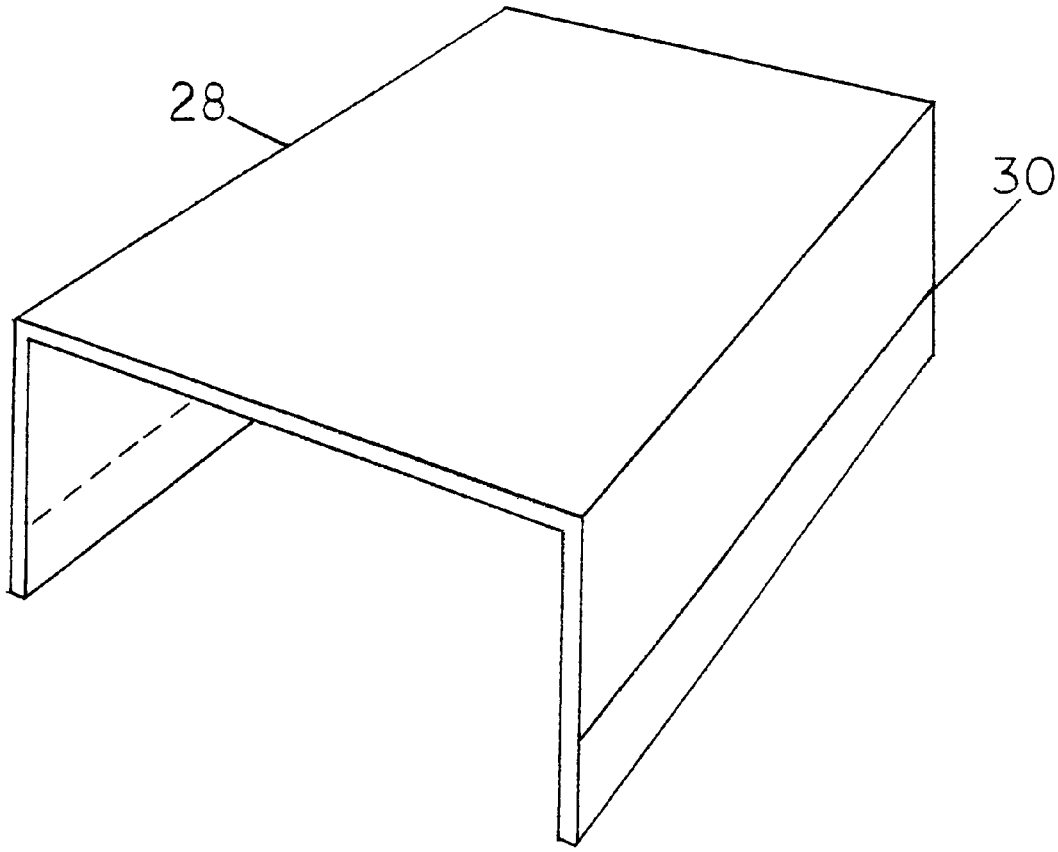

FIG. 7 is a perspective view of an adjustable height, light weight shelf.

Figure 7A:
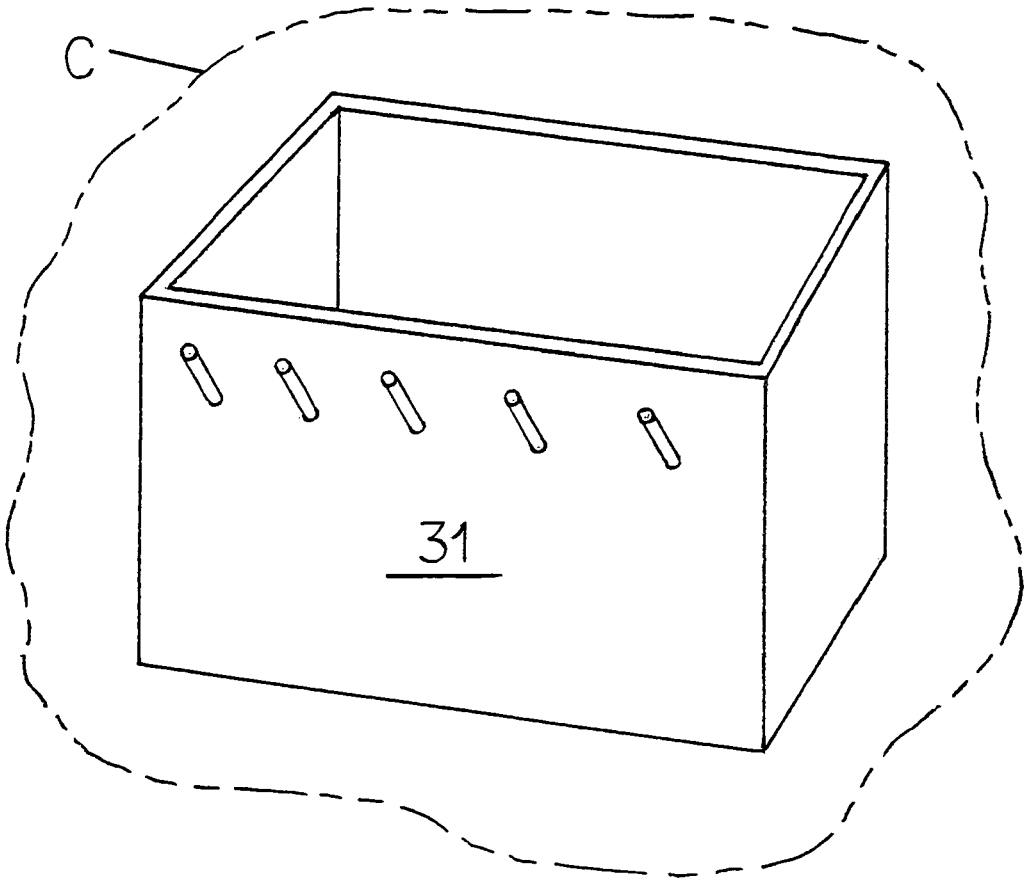

FIG. 7A is a perspective view of an attached prescription drug box with safe storage for keys.

FIG. 8 is a perspective, cut-away view of a secret compartment divider.

FIG. 9 is a perspective view of the box installed in a vehicle having a front bench seat.

FIG. 10 is a perspective view of the box secured by an eye bolt and lock to an SUV cargo ring.

FIG. 11 is a perspective view of the box installed in the trunk of an auto.

FIG. 12 is a plan view of the box installed on the center floor of an auto convenient to a driver.

Figure 13:
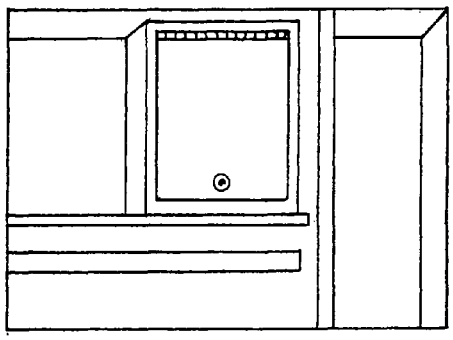

FIG. 13 is a frontal view of the fully extended box secured to a closet shelf.

Figure 14:
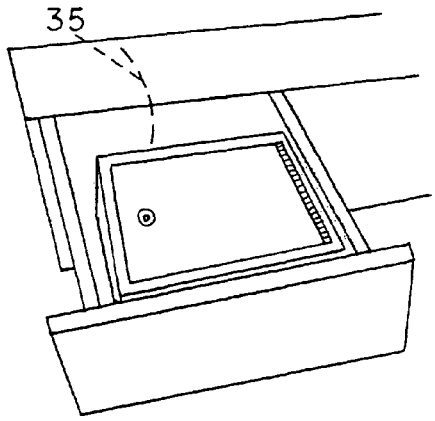

FIG. 14 is a perspective view of the eleven inch box secured within a file drawer.

Figure 15:
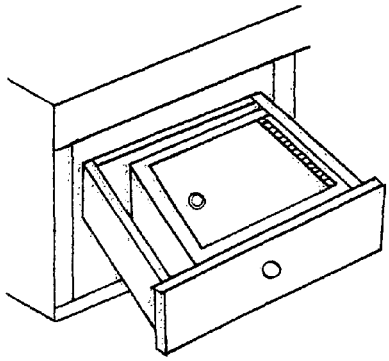

FIG. 15 is a perspective view of the fully compacted box secured within a dresser drawer.

Figure 16:
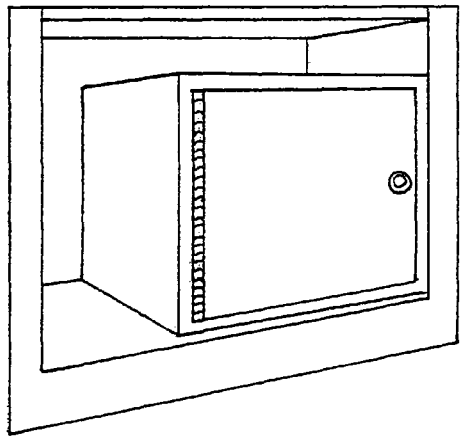

FIG. 16 is a view of the box extended to ten inches and secured within an upper kitchen cabinet.

Figure 17:
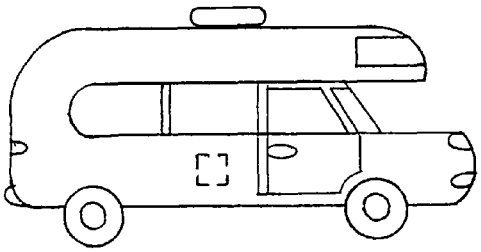

FIG. 17 is a side view of a camper with the box secured within.

Figure 18:
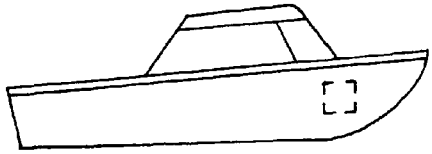

FIG. 18 is a side view of a boat with the box secured within.

Figure 19:
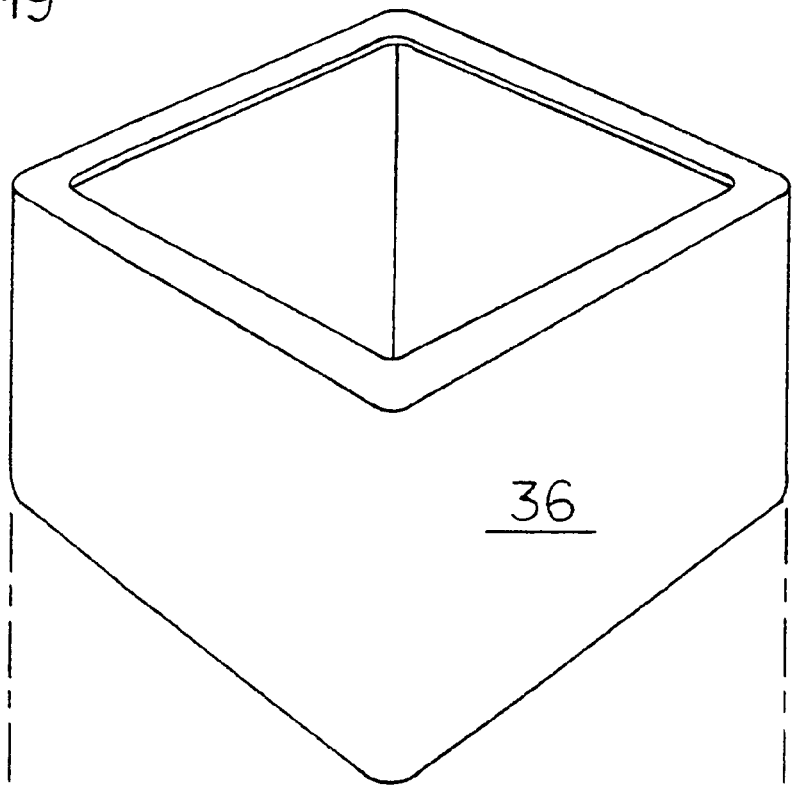

FIG. 19 is a perspective view of a padded slip-on box cover.

Figure 20:
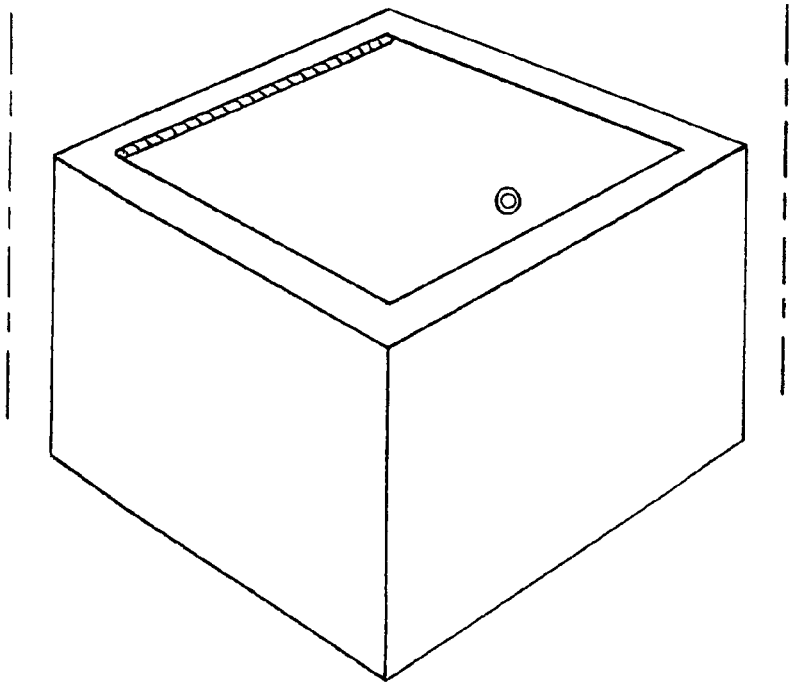

FIG. 20 is a perspective view of the box before receiving the cover.

Figure 21:
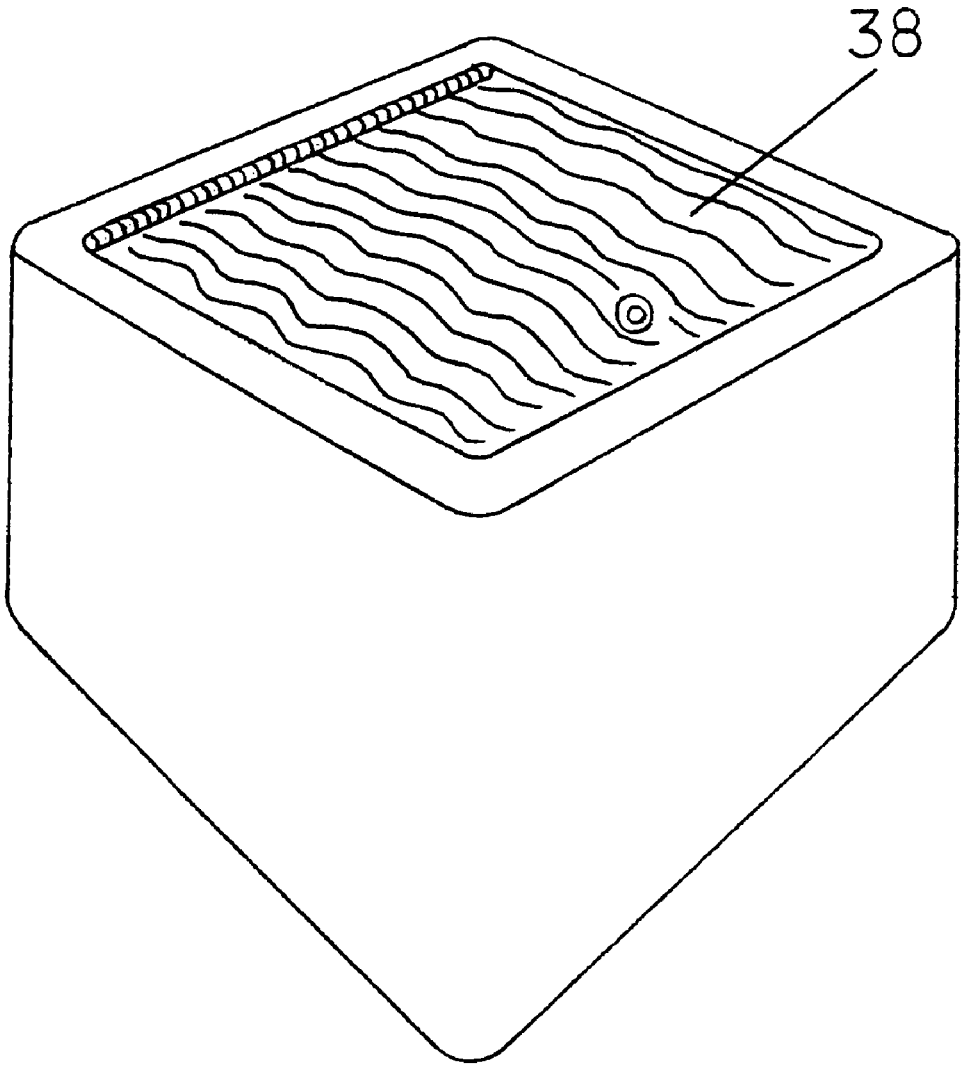

FIG. 21 is a perspective view of the box with optional door cover.

Figure 22:
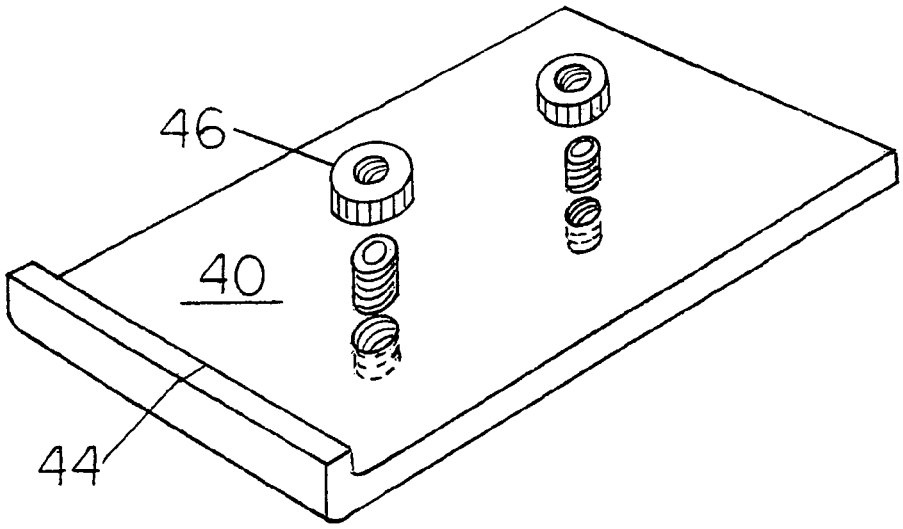

FIG. 22 is a perspective view of a Quick Release Plate.

Figure 23:
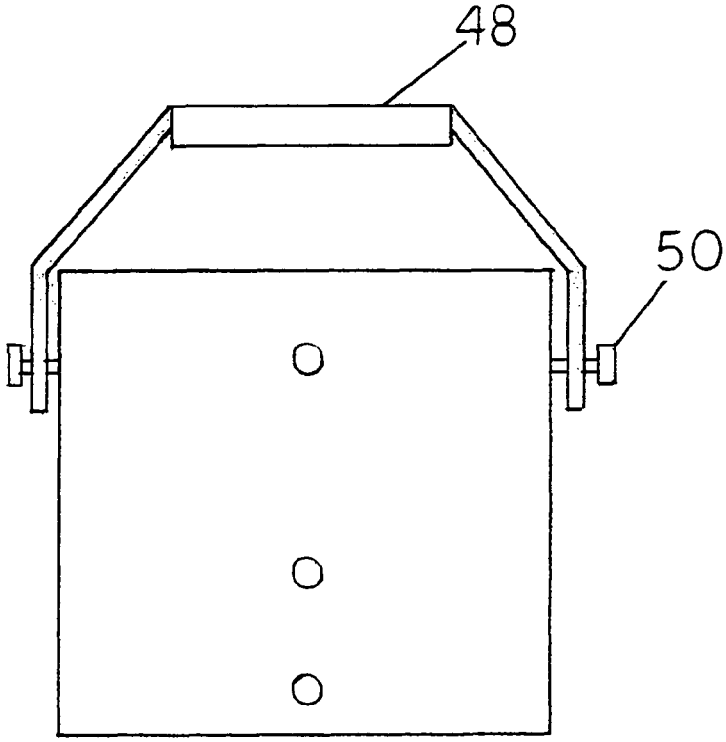

FIG. 23 is a frontal view of the box with carrying handle.

Figure 24:
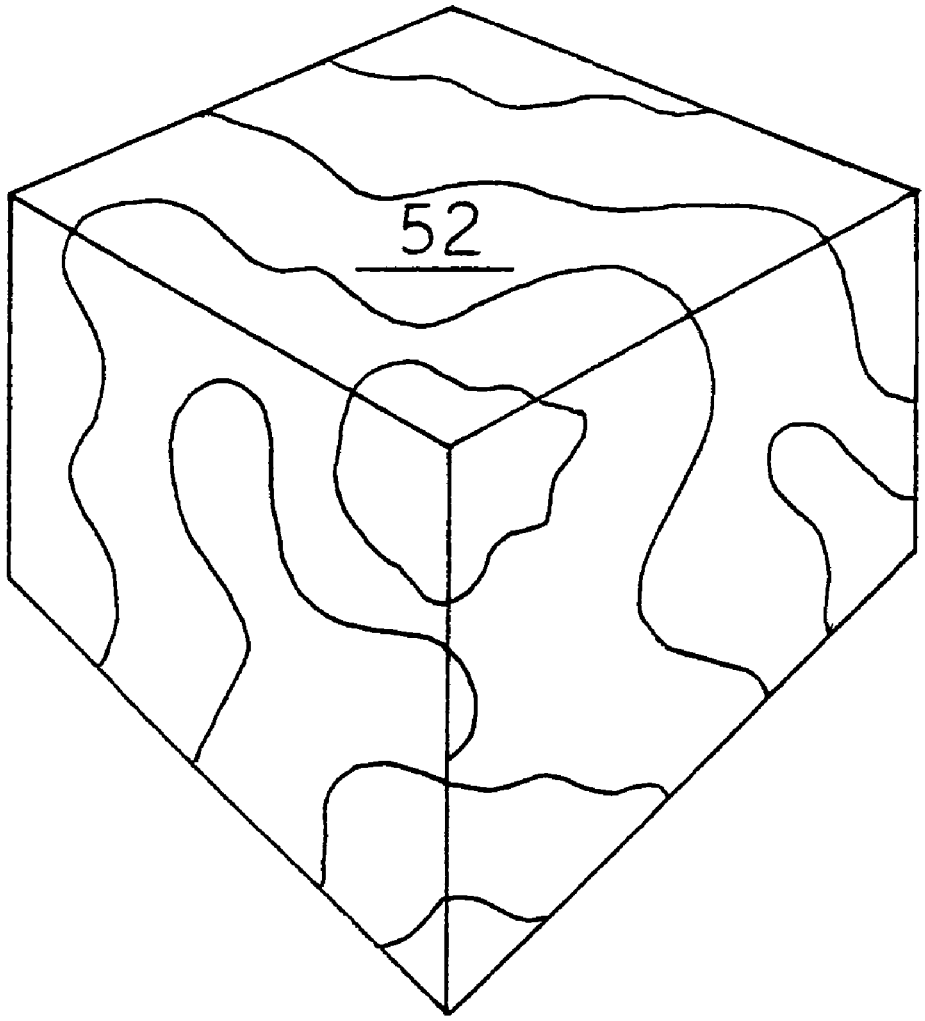

FIG. 24 is a perspective view of a camouflaged box cover.

Figure 25:
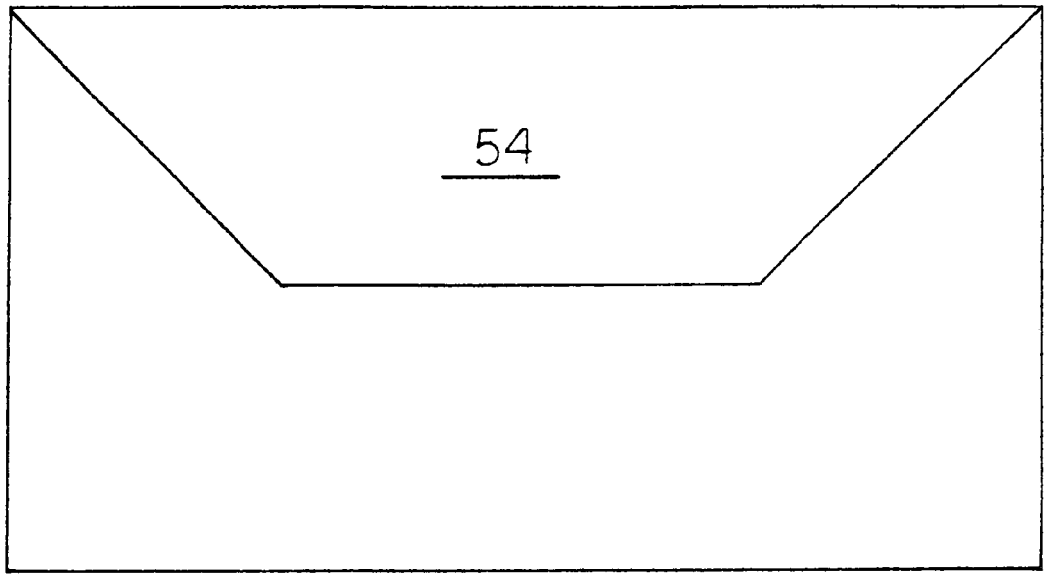

FIG. 25 is a plan view of an envelope representing a secret retail business promotion plan.

Figure 26:
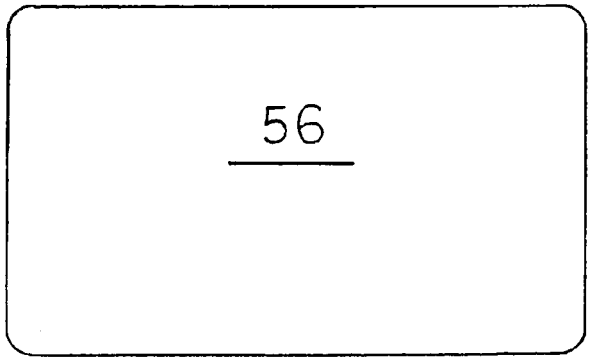

FIG. 26 is a perspective view of a "peel and stick" double faced sheet.

Note: A manufacturer would decide on how many telescoped sizes would be desirable.

3 holes in A+7 in B=7 sizes. 7-8-9-10-11-12 & 13 inches.

3 holes in A+4 in B=4 sizes. 7-9-11-13 inches.

3 holes in A+3 in B=3 sizes. 7-10-13 inches.

2 holes in A+2 in B=2 sizes 7-13 inches.

By using overlap only any lengths between 7 & 12 inches are attainable with 2 holes in A+2 holes in B.

The same reference numerals refer to the same parts throughout the various Figures.

With reference now to the drawings, and in particular to FIGS. 1, 4, 5 and 6 thereof, the presently preferred embodiment of the new and improved home type telescopic Security box embodying the principles and concepts of the present invention and generally designated by the numeral 10 will be described.

DESCRIPTION OF THE PREFERRED EMBODIMENT

With reference now to the drawings, and in particular to FIG. 1 thereof, the preferred embodiment of the new and improved telescopic security box system embodying the principles and concepts of the present invention and generally designated by the reference numeral 10 will be described.

The present invention, the telescopic security box is comprised of a plurality of components. Such components in their broadest context include an outer, fixable compartment A, an inner compartment B having a closed end, and telescopically slid able within A, to a predetermined fixed position, and door C adapted to function as an accessible opening with the door having at least one lock. Such components are individually configured and correlated with respect to each other so as to attain the desired objective.

First provided is a front component, A. The front component is in a generally rectilinear configuration. The front component has a horizontal top panel. The front component has a parallel bottom panel. The top and bottom panels are separated by a height. The front component has a vertical left side panel. The front component has a parallel right side panel. The left and right side panels are separated by a width. The front component has a vertical rear opening. The front component also has a parallel front opening. The rear and front openings are separated by a depth.

A rear component, B, is provided. The rear component is in a generally rectilinear configuration. The rear component has a horizontal top panel. The rear component has a parallel bottom panel. The top and bottom panels are separated by a height. The rear component has a vertical left side panel. The rear component has a parallel right side panel. The left and right side panels are separated by a width. The rear component has a vertical rear panel. The rear component has a parallel front opening. The rear panel a the front openings are separated by a depth. The height and width of the rear component are less than the height and width of the front component. The depth of the rear component is essentially equal to the depth of the front component. The rear component is slidable between a contracted orientation and an extended orientation. In the contracted orientation all of the rear component is within the front component. In the extended orientation the majority of the rear component is rearwardly of the front component.

A door, C, is provided. The door has a hinge. The hinge pivotally couples the door to the front opening of the front component adjacent to the right side panel of the front component. The door is pivotable between an open orientation and a closed orientation. The open orientation is parallel with the right side panel of the front component. The closed orientation is parallel with and closes the front opening of the front component. The door has a lock. The lock is adapted to selectively lock the door in the closed orientation.

A size limiter is provided. The size limiter includes an in-turned lip at the rear opening of the front component. The size limiter is in sliding contact with the upper and lower and side panels of the rear component. The size limiter includes an out-turned lip at the front opening of the rear component. The out-turned lip is provided in sliding contact with the upper and lower and side panels of the front component. The in-turned lip and the out-turned lip are in interference relationship. In this manner the slid limiter is adapted to preclude the rear component moving rearwardly and separating from the front component.

On another embodiment, a plurality of bolt holes 14 are provided. The bolts holes are provided through the upper, lower, left and right panels of the front and rear components. The bolt holes are aligned midway on the left, right, upper and lower panels. A bolt 18 is provided. The bolt extends through a bolt hole of the front component and the rear component. In this manner the front and rear components are secured in a fixed orientation with respect to each other.

The panels have a plurality of supplemental holes, 16. The supplemental holes are adapted to facilitate coupling of the system to another object.

The rear component has a false panel. The false panel is provided spaced from and parallel with the rear panel. The false panel is spaced from the rear panel by a distance between 10 and 50 percent of the depth of the rear component, Further provided is a shelf, 28. The shelf is in an inverted U-shaped configuration. The shelf has a horizontal central portion. The shelf has two depending legs. The central portion has a depth less than the depth of the rear component. The legs have an adjustable height of between 40 and 60 percent of the height of the rear component.

Provided last is a prescription drug box. The prescription drug box is in a rectilinear configuration and of a size for being conveniently attached interiorly to the door when opened, provision being made for hanging keys.

FIG. 1 is an isometric view of the telescopic security box fully extended. The parts of the box consist of: outer compartment A, inner telescopic part B with hinged door and key lock and/or a combination lock. Parts A & B slide in close proximity to each other. Assembly 10. A+B is shown as an overlap. Typical bolt down hole of A, 12. Typical bolt down hole of B, 14. Various extension holes in B 16 align with those in A.

FIG. 1A illustrates bolt 18 securing A through a fixed surface such as a closet shelf.

FIG. 1B shows attachment of B in a like manner.

FIG. 1C shows bolt with built-in lock washer 20 securing A to B at overlap area.

The above constitutes A FIRST EMBODIMENT.

FIG. 2 depicts an anti-pry overlap only without securing bolts as in FIG. 1C. For instance 7 inches when fully compacted. 6-5-4-3 or a minimum of 2 inches overlap when extended to 12 inches overall. The artisan who built the prototype, with many years experience in sheet metal work, said the box would need to be torn apart with tools to obtain the contents. Doors are generally more vulnerable. Plus a burglar would probably not realize there are two closely overlapped parts. This is the simplest and probably less costly way to manufacture the box. Testing could suggest it is adequate without bolts. This is a SECOND EMBODIMENT.

Again referring to FIG. 2, an alternate 360° perimeter bonding strip, not shown, is adapted for bonding Part A to Part B in lieu of bolts as in FIG. 1C.

This after the user selects a telescoped overall length of the box. For instance a common household iron could activate the strip. This is a THIRD EMBODIMENT.

FIG. 3 is an isometric view of the compacted box of any embodiment.

FIG. 4 is a plan view of a telescopic box featuring interlocking parts B to part A. Parts B are inserted into A. Then provided are spot welds around A. 360° of interlock areas is depicted by 22. The preceding is a FOURTH EMBODIMENT featuring, as an example, 7-10 & 13 inch sizes.

FIG. 5 shows a box with one extension in a compact state after C is spot welded 24 onto A. FIGS. 1 through 5 constitute the primary embodiment of the present invention.

DESCRIPTION OF THE DRAWINGS

With reference now to the drawings, and in particular to FIG. 1, an embodiment of the new and improved home type telescopic Security box embodying the principles and concepts of the present invention and generally designated by the numeral 10 will be described.

The present invention, the telescopic security box is comprised of a plurality of components. Such components in their broadest context include an outer, fixable compartment A, an inner compartment B having a closed end, and telescopically slid able within A, to a predetermined fixed position, and an accessible opening C having at least one lock. Such components are individually configured and correlated with respect to each other so as to attain the desired objective.

The present invention essentially comprises a telescopic security box. First provided is a lock 12 on an accessible opening C. The box has a matching series of holes 14 and 16 for separately securing A and/or B to a solid surface, preferably, with bolts 18, FIG. 1A and FIG. 1B. And, also for joining A to B with a bolt lock nut combination 20, FIG. 1C. A spring 22 warns of an unlocked condition, FIG. 1D. FIG. 2 illustrates the box partially extended. FIG. 3 shows the box compacted for economical shipping and retail shelf display. FIG. 4 is a plan view of an embodiment of manufacture illustrating a clasping 24 of parts A and B in an extended mode. FIG. 5 is a plan view of the box fully retracted. Spot welds 26 join A to C. FIG. 6 is a plan view showing two extensions. FIG. 7 is a perspective view of a light weight, adjustable height, shelf 28 with scored or printed cut line 30. FIG. 7A is a perspective view of a prescription drug storage box 31 with supports for key storage. FIG. 8 is a perspective view of B showing a hidden compartment divider 32. FIG. 9 is a perspective view of a front bench seat with box secured to the floor. FIG. 10 is a perspective view of the box with an eye bolt 34 secured to an SUV cargo ring via a lock. FIG. 11 is a perspective view of the box secured in a trunk. FIG. 12 is a plan view of the box installed behind a console. FIG. 13 is a frontal view of the fully extended box secured to a closet shelf.

FIG. 14 is a view in perspective of a vertical, partially extended, installation in a desk file drawer. Component 35 is a cable designed to prevent a thief from simply stealing the entire drawer. FIG. 15 is a perspective view of the fully compacted box secured within a dresser drawer. FIG. 16 is a perspective view of a partially extended box secured within an upper kitchen cabinet. Cabinet door is not shown. FIG. 17 is a side view of an RV showing installation within. FIG. 18 is a side view of an installation in a boat. FIG. 19 is a perspective view of an attractive box cover 36 preferably in padded leather. FIG. 20 shows the box in perspective ready to receive the cover. FIG. 21 shows the box in perspective with self adhesive appliqué accessory 38 designed to complement the vehicle's interior trim. FIG. 22 illustrates a Quick Release Plate 40 to facilitate temporary attachment of the box to a solid surface. Bolts 42 threaded on bottom of plate for attachment to the vehicle body and on top for securing the box are supplied. A centering mark 44 guides user to the bolts which then secure the box by means of nuts 46. No tools or keys are required as in prior arts. FIG. 23 is a frontal view of the box with temporary carrying handle 48 utilizing existing holes with bolt and nut sets 50. FIG. 24 is a view in perspective of a camouflaged box cover 52. FIG. 25 is a plan view of an envelope 54 representing a secret business plan, associated with the invention. FIG. 26 is a perspective view of a double peel and stick sheet of commercial grade adhesive 56.

Presently I favor the FIRST EMBODIMENT as a blend of manufacturing methods, costs, versatility, and ample security considering low cost of product. However, one or more of the other embodiments, possibly in combination, seem to be satisfactory.

REFERENCE LETTERS AND NUMERALS

10 Encompassing A, B and C.
A Front component
B Rear component
C Door
12 Lock
14 & 16 Holes for securing components.
18 Bolt/nut for securing box to solid surface.
20 Bolt/nut to join A to B.
22 Door spring to warn of unlocked condition.
24 360 degree overlap.
26 Spot welds securing C to A.

28 Height adjustable shelf.
30 Cut line to lower shelf.
31 Prescription box with key hangers.
32 Hidden compartment panel.
34 Eye bolt for securing to SUV cargo ring etc.
35 Cable to prevent burglar from taking entire drawer and box.
36 Padded box enclosure.
38 Wood grained door appliqué.
40 Quick Release Plate.
42 Attachment bolts for vehicle.
44 Guide line for centering box on bolts.
48 Carrying handle.
50 handle bolts.
52 Camouflage cover.
54 Envelope representing secret business plan for telescopic security box retail promotion.
56 Double faced adhesive panel.

Operation

In operation the user selects a fixed surface to install the security box such as: a closet shelf, a kitchen cabinet, a deep desk file drawer or other large object including vehicles, boats and RVs.

Depending on space available, the amount and size of objects to secure, the user has the versatility of the compact size or the telescopically extended one. When installed in a vehicle the security box could be quickly and easily removed without tools, via an optional Quick Release Plate. It would be accessible from within the box by turning two knurled nuts, then lifting the box clear.

An optional carrying handle may be utilized for securing valuables during a vacation or weather related emergency evacuation.

A second box for permanent installation in a vehicle, boat, travel trailer, motor home or private aircraft would be a wise and economical investment in deterring theft.

The present invention essentially comprises a telescopic security box. First provided is a lock 12 on an accessible opening C. The box has a matching series of holes 14 and 16 for separately securing A and/or B to a solid surface, preferably, with bolts 18, FIG. 1A and FIG. 1B. And, also for joining A to B with a bolt lock nut combination 20, FIG. 1C. A spring 22 warns of an unlocked condition, FIG. 1D. FIG. 2 illustrates the box partially extended. FIG. 3 shows the box compacted for economical shipping and retail shelf display. FIG. 4 is a plan view of an embodiment of manufacture illustrating a clasping 24 of parts A and B in an extended mode. FIG. 5 is a plan view of the box fully retracted. Spot welds 26 join A to C. FIG. 6 is a plan view showing two extensions. FIG. 7 is a perspective view of a light weight, adjustable height, shelf 28 with scored or printed cut line 30. FIG. 7A is a perspective view of a prescription drug storage box 31 with supports for key storage.

FIG. 8 is a perspective view of B showing a hidden compartment divider 32. FIG. 9 is a perspective view of a front bench seat with box secured to the floor. FIG. 10 is a perspective view of the box with an eye bolt 34 secured to an SUV cargo ring via a lock. FIG. 11 is a perspective view of the box secured in a trunk. FIG. 12 is a plan view of the box installed behind a console. FIG. 13 is a frontal view of the fully extended box secured to a closet shelf.

FIG. 14 is a view in perspective of a vertical, partially extended, installation in a desk file drawer. Component 35 is a cable designed to prevent a thief from simply stealing the entire drawer.

FIG. 15 is a perspective view of the fully compacted box secured within a dresser drawer.

FIG. 16 is a perspective view of a partially extended box secured within an upper kitchen cabinet. Cabinet door is not shown.

FIG. 17 is a side view of an RV showing installation within.

FIG. 18 is a side view of an installation in a boat.

FIG. 19 is a perspective view of an attractive box cover 36 preferably in padded leather.

FIG. 20 shows the box in perspective ready to receive the cover.

FIG. 21 shows the box in perspective with self adhesive applique accessory 38 designed to complement the vehicle's interior trim.

FIG. 22 illustrates a Quick Release Plate 40 to facilitate temporary attachment of the box to a solid surface. Bolts 42 threaded on bottom of plate for attachment to the vehicle body and on top for securing the box are supplied. A centering mark 44 guides user to the bolts which then secure the box by means of nuts 46. No tools or keys are required as in prior arts.

FIG. 23 is a frontal view of the box with temporary carrying handle 48 utilizing existing holes with bolt and nut sets 50.

FIG. 24 is a view in perspective of a camouflaged box cover 52.

FIG. 25 is a plan view of an envelope 54 representing a secret business plan, associated with the invention.

FIG. 26 is a perspective view of a double peel and stick sheet of commercial grade adhesive 56.

The overlap of A and B is reinforced by bolt and lock nut sets 20 on top and both sides of the box. The bottom components of the box A and B are separately fixed by fasteners 18 to a solid surface. Therefore, an additional bolt and lock nut on the bottom is not required.

In another configuration the simple overlap of A and B would provide sufficient rigidity to prevent unauthorized and easy access to the contents. The craftsman who made the prototype, having decades in sheet metal constructions, referring to this embodiment said, "A thief would not be able to remove contents without the use of tools and sufficient time." He further stated the invention was not obvious to him. This would be the simplest, most economical method of construction.

In the presently preferred configuration an interlocking or clasping method of joining the components A and B provides four layers of material, preferably steel, at 360 degree overlaps.

SOCIETAL BENEFITS: Theft prevention & prescription drug security benefits for families, children, law enforcement, medical facilities and government at all levels.

A GREEN PRODUCT 46% smaller+25% lighter=Energy savings. Ex. Less truck fuel.

ECONOMIC BENEFITS: Enables production, distribution of a durable safety box+creates jobs.

The present invention is an economical security box telescopically adaptable to suit storage needs and various attachment surfaces. Easily installed in a home, apartment, office, business, car, van, SUV, truck, travel trailer, motor home, private aircraft or boat.

Examples include: secured; on a closet shelf; in a kitchen cabinet, in a deep desk drawer or under a counter. The box can be temporarily removed from a home, then quickly and easily reinstalled in a vehicle for a vacation trip, or during a weather related evacuation, by means of a Quick Release Plate. Or, permanently installed in the trunk of a car, in a truck, temporarily padlocked to a cargo ring in a SUV, van or within any other vehicle. The economical security box provides versatile and much needed security from thieves while securing items from children. The box helps in fulfilling a global need for home, workplace, and/or vehicle security.

A secret business promotion plan with related hardware is a part of this application.

In conclusion, the embodiments described herein constitutes a significant contribution toward crime prevention. Gains from theft fuel more serious crimes. Also helps prevent children from gaining access to prescription drugs stored without security.

Example Home Medicine Cabinet!

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A telescopic security box system comprising:

a front component having top and bottom panels separated by a height, left and right side panels separated by a width, a rear opening and parallel front opening separated by a depth;

a rear component having top and bottom panels separated by a height, left and right side panels separated by a width, a rear panel and a parallel front opening separated by a depth, the rear component being slidable between a forward contracted orientation with all of the rear component within the front component and a rearward extended orientation with portions of the rear component rearwardly of the front component;

a plurality of bolt holes through the front and rear components, a bolt extending through a bolt hole of the front component and through a bolt hole of the rear component to secure the front and rear components in any of a plurality of fixed orientations with respect to each other to thereby increase and decrease the size of the system;

a door with a hinge pivotally coupling the door to the front opening of the front component, a lock adapted to selectively lock the door in a closed orientation; and a size limiter to preclude the rear component moving rearwardly and separating from the front component.

2. The system as set forth in claim 1 wherein the plurality of bolt holes includes a plurality of bolt holes through the top and bottom panels of the front and rear components, the bolt holes being aligned midway between the left and right side panels of the front and rear components, bolt holes similarly aligned on the left and right panels, a bolt extending through a bolt hole of the front component and the rear component to secure the front and rear components in a fixed orientation with respect to each other.

3. The system as set forth in claim 1 and further including:

a plurality of supplemental holes (16) in the panels, the supplemental holes adapted to facilitate coupling of the system to another object.

4. The system as set forth in claim 1 and further including:

a false panel in the rear component spaced from and parallel with the rear panel, the false panel being spaced from the rear panel by a distance between 10 and 50 percent of the depth of the rear component.

5. The system as set forth in claim 1 and further including:

a prescription drug box in a rectilinear configuration and of a size for being conveniently attached interiorly to the door when opened, provision being made for hanging keys.

6. The system as set forth in claim 1 and further including:

an intermediate component operatively oriented between the front and rear components, the intermediate component having top and bottom panels separated by a height, left and right side panels separated by a width, a rear opening and front opening separated by a depth.

7. The system as set forth in claim 1 and further including a quick release plate with a centering mark to guide the system to protrusion bolts abating the need for tools and keys.

8. A telescopic security box system comprising:

a front component having top and bottom panels separated by a height, left and right side panels separated by a width, a rear opening and parallel front opening separated by a depth;

a rear component having top and bottom panels separated by a height, left and right side panels separated by a width, a rear panel and a parallel front opening separated by a depth, the rear component being slidable between a forward contracted orientation with all of the rear component within the front component and a rearward extended orientation with portions of the rear component rearwardly of the front component;

a door with a hinge pivotally coupling the door to the front opening of the front component, a lock adapted to selectively lock the door in a closed orientation;

a size limiter to preclude the rear component moving rearwardly and separating from the front component; and a shelf in an inverted U-shaped configuration, the shelf having a horizontal central portion with two depending legs, the central portion having a depth less than the depth of the rear component, the legs having an adjustable height of between 40 and 60 percent of the height of the rear component.

9. A telescopic security box system (10) for storing valuables in homes, vehicles, work places and the like, the system having size varying capabilities to facilitate storage and transportation and to allow positioning at a wide variety of locations, the storing and transporting and positioning being done in a safe, convenient and economic manner, the system comprising, in combination:

a front component (A) in a generally rectilinear configuration having a horizontal top panel and a parallel bottom panel separated by a height, the front component having a vertical left side panel and a parallel right side panel separated by a width, the front component having a vertical rear opening and a parallel front opening separated by a depth;

a rear component (B) in a generally rectilinear configuration having a horizontal top panel and a parallel bottom panel separated by a height, the rear component having a vertical left side panel and a parallel right side panel separated by a width, the rear component having a vertical rear panel and a parallel front opening separated by a depth, the height and width of the rear component being less than the height and width of the front component, the depth of the rear component being essentially equal to the depth of the front component, the rear component being slidable between a contracted orientation with all of the rear component within the front component and an extended orientation with portions of the rear component rearwardly of the front component;

a door (C), a hinge pivotally coupling the door to the front opening of the front component adjacent to one side panel of the front component, the door being pivotable between an open orientation and a closed orientation, the open orientation being parallel with the one side panel of the front component, the closed orientation being parallel with and closing the front opening of the front component, a lock adapted to selectively lock the door in the closed orientation;

a size limiter, the size limiter including an in-turned lip at the rear opening of the front component in sliding contact with the top and bottom and side panels of the rear component, the size limiter including an out-turned lip at the front opening of the rear component in sliding contact with the top and bottom and side panels of the front component, the in-turned lip and the out-turned lip being in interference relationship whereby the size limiter is adapted to preclude the rear component moving rearwardly and separating from the front component, the turned lips of the front and rear components coupling together;

a plurality of bolt holes (14) through the top and bottom and left and right side panels of the front and rear components, the bolt holes being aligned midway between the left and right side panels, a bolt (18) extending through a bolt hole of the front component and the rear component to secure the front and rear components in a fixed orientation with respect to each other;

a plurality of supplemental holes (16) in the panels, the supplemental holes adapted to facilitate coupling of the system to another object;

a false panel in the rear component spaced from and parallel with the rear panel, the false panel being spaced from the rear panel by a distance between 10 and 50 percent of the depth of the rear component;

a shelf (28) in an inverted U-shaped configuration, the shelf having a horizontal central portion with two depending legs, the central portion having a depth less than the depth of the rear component, the legs having an adjustable height of between 40 and 60 percent of the height of the rear component; and a provision being made for a drug box in a rectilinear configuration and of a size for being conveniently attached interiorly to the door when opened, provision being made for hanging keys.

* * * * *